US006293428B1

(12) United States Patent
Chen

(10) Patent No.: US 6,293,428 B1
(45) Date of Patent: Sep. 25, 2001

(54) DROPPING CONTROL MECHANISM FOR SOAP FEEDING DEVICE

(76) Inventor: Yi-Chen Chen, No. 68-31, Yan Ji St., Da An Area, Taipei (TW)

( * ) Notice: Subject to any disclaimer, the term of this patent is extended or adjusted under 35 U.S.C. 154(b) by 0 days.

(21) Appl. No.: 09/599,859

(22) Filed: Jun. 23, 2000

(51) Int. Cl.[7] ..... B67D 5/08

(52) U.S. Cl. ..... 222/55; 222/52; 222/63; 222/420

(58) Field of Search ..... 222/52, 55, 63, 222/420, 422

(56) References Cited

U.S. PATENT DOCUMENTS 4,917,265 * 4/1990 Chiang ..... 222/52
4,946,070 * 8/1990 Albert et al. ..... 222/52
5,344,047 * 9/1994 Chen ..... 222/63
5,836,482 * 11/1998 Ophardt et al. ..... 222/325
5,927,547 * 7/1999 Papen et al. ..... 222/57
6,036,056 * 3/2000 Lee et al. ..... 222/63
6,203,759 * 3/2001 Pele et al. ..... 422/100
6,213,354 * 4/2001 Kay ..... 222/420

* cited by examiner

*Primary Examiner*—J. Casimer Jacyna
(74) *Attorney, Agent, or Firm*—Bacon & Thomas, PLLC

(57) ABSTRACT

A soap feeding device mounted in a housing comprises an upper housing having a soap reservoir and a lower housing having a control assembly consisting of a power source, a sensor means including a circuit board, a transmission means including a drive means, a reduction gear set, and a crankshaft, and a feeding means. A setting switch on circuit board is extended through hole in the bottom of lower housing being enclosed by a waterproof silicone switch such that user may press the silicone switch to set the dropping of the device. The power source is activated once the sensor senses the stretching out of ones hand. Then reduction gear set is driven to rotate. The rotation of the gear causes the crankshaft to reciprocally move between a pair of clips. Thus the actuated bellow-like extruder compresses air into a barrel which is in cooperation with valve and poppet to extrude soap.

5 Claims, 6 Drawing Sheets

DROPPING CONTROL MECHANISM FOR SOAP FEEDING DEVICE

FIELD OF THE INVENTION

The present invention relates to a dropping control mechanism for soap feeding device with easy dropping setting and waterproof characteristics.

BACKGROUND OF THE INVENTION

A conventional soap feeding device comprises a housing, a drive means, an infrared sensor, and a feeding means. A reservoir for storing soap is provided in the housing. A barrel is attached to the outlet in the bottom of the soap reservoir. A slidable valve provided is in the barrel. Valve is a plate member having a plurality of through holes, an annular membrane adhered to the wall of the barrel, a spindle passed through the valve, a spring put on upper part of the spindle, a poppet sleeved on the lower part of the spindle, a tube provided on the side of barrel, an extruder sleeved on the tube, a connecting rod having one end pivotably connected to the extruder, a cam pivotably connected to the other end of the connecting rod, a motor, and a gear set for passing the motion of the motor to the cam.

The infrared sensor is activated when the transmitted ray is interrupted by an object (e.g., hand) which in turn causes motor to drive the feeding means. Then extruder is compressed to extrude soap through the outlet. Once a predetermined amount of soap is extruded the feeding means is deactivated by a dropping control mechanism (not further shown). Thus stops the extrusion of soap.

But this is unsatisfactory for the purpose for which the invention is concerned for the following reasons:

1. The setting of dropping is factory preset. For example, one drop or two drops. User is not allowed to set the device to drop more in each stretching out of one's hand. However, there are occasions such as in the hospital a large amount of soap required in each stretching out of one's hand. The only way to obtain such large amount of soap is to stretch out one's hand repeatedly until the required amount of soap is reached. This is quite inconvenient.
2. The extruder may vibrate during the extrusion process. This causes a not so smooth operation of soap feeding device. Thus the feeding means needs to be improved.

SUMMARY OF THE INVENTION

It is thus an object of the present invention to provide a dropping control mechanism for soap feeding device. The mechanism can be set by user based on demand in order to extrude a required amount of soap including a plurality of drops from the soap feeding device in one stretching out of one's hand.

To achieve the above and other objects, the present invention provides a dropping control mechanism for soap feeding device. Soap feeding device is mounted in a housing comprising an upper housing having a soap reservoir and a cover hinged to the soap reservoir, and a lower housing having a control assembly consisting of a power source, a sensor means, a transmission means including a drive means, a reduction gear set, and a crankshaft, and a feeding means.

Sensor means comprises a circuit board, a setting switch on circuit board extended through hole in the bottom of lower housing, a waterproof silicone switch enclosed the setting switch such that user may press the silicone switch to set the dropping of the soap feeding device, an infrared sensor, and an LED indicator for indicating the number of drops in each stretching out of one's hand. In setting the dropping, user may press the silicone switch a desired number of times.

The power source is activated once the infrared sensor senses the stretching out of one's hand. Then motor of the drive means is activated to cause reduction gear set to rotate. An eccentric ring having to hooks is provided on the gear. Each hook is hooked on the engagement end of crankshaft. As such, the rotation of the gear may cause the engagement end to move the cylindrical end of the L-shaped crankshaft. The movement of the cylindrical end is defined by the pair of dips raised on the bottom of lower housing. Thus the cylindrical end of the L-shaped crankshaft is limited to a reciprocating motion.

Also, the cylindrical end of the L-shaped crankshaft is inserted in the end of movable extruder of feeding means. As such, the bellow-like extruder may compress air into a barrel. The vibration of the cylindrical end of the L-shaped crankshaft during the extrusion of extruder as experienced in the prior art is eliminated due to the insertion of cylindrical end into the clips in the lower housing. Thus a smooth extrusion of soap is effected.

Barrel is in fluid communication with the outlet in the bottom of soap reservoir of upper housing. Barrel comprises a slidable plate-shaped valve having a plurality of through holes, an annular membrane adhered to the wall of the barrel, a spindle extended down from the valve, a spring anchored on top of the valve, a cap on top of spring, the periphery of cap engaged with the top of barrel, a plurality of apertures on the cap for permitting soap to flow through into barrel, and a poppet member having a center hole put on the spindle and a poppet. The seat of poppet member is biased against the bottom hole of barrel for blocking soap passage when the soap feeding device is not activated.

When extruder is compressed, valve is moved up due to the upward movement of poppet actuated by extruder. As a result, the bottom hole of barrel is open to permit soap to pass for extruding through the outlet in the bottom of lower housing. In the immediate expansion of extruder, crankshaft moves back to its original position which in turn causes a sucking effect in barrel. As a result, soap is supplied from soap reservoir to the barrel through apertures and poppet.

A pivot member is formed in the lower housing. A push-button switch is also formed on circuit board. A projection is provided on an eccentric position of large gear. Projection will engage with one end of pivot member when extruder is compressed by the rotation of large gear. As such, the other end of pivot member presses the push-button switch once in each extrusion of soap. Above extrusion may repeat until the times of dropping set by user in advance has been reached. Once reached, the drive means is deactivated by the circuit board.

The above and other objects, features and advantages of the present invention will become apparent from the following detailed description taken with the accompanying drawings.

DETAILED DESCRIPTION OF THE PREFERRED EMBODIMENTS

Figure 1:
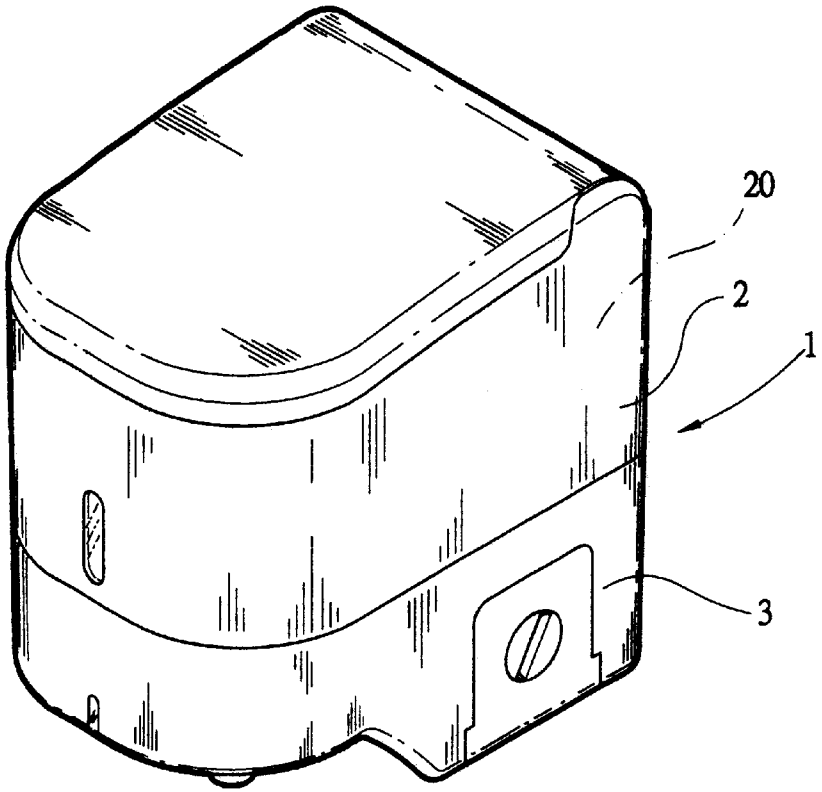
FIG. 1 is a perspective view of a preferred embodiment of soap feeding device according to the invention.
Figure 2:
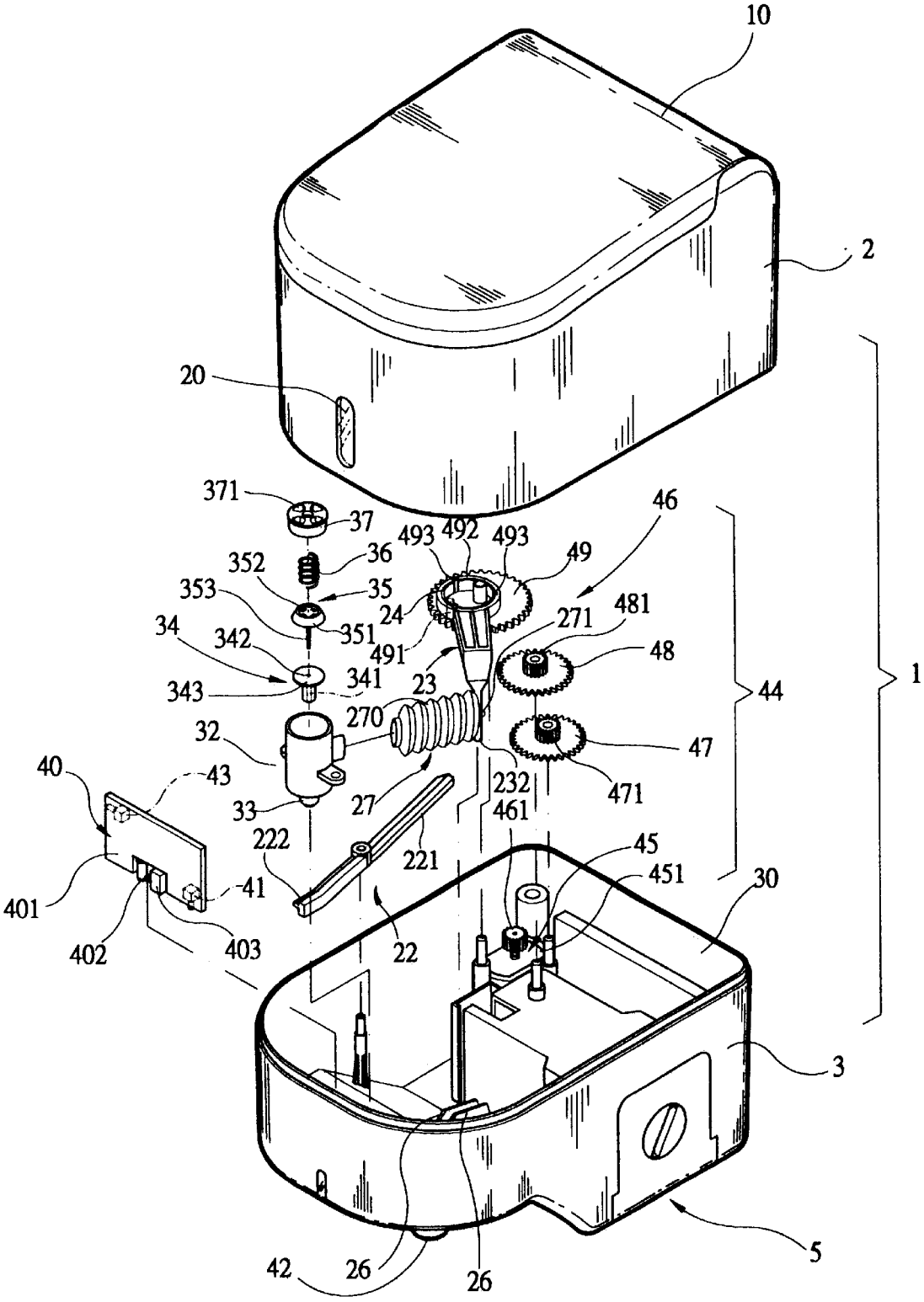
FIG. 2 is an exploded view of the soap feeding device of FIG. 1.
Figure 3:
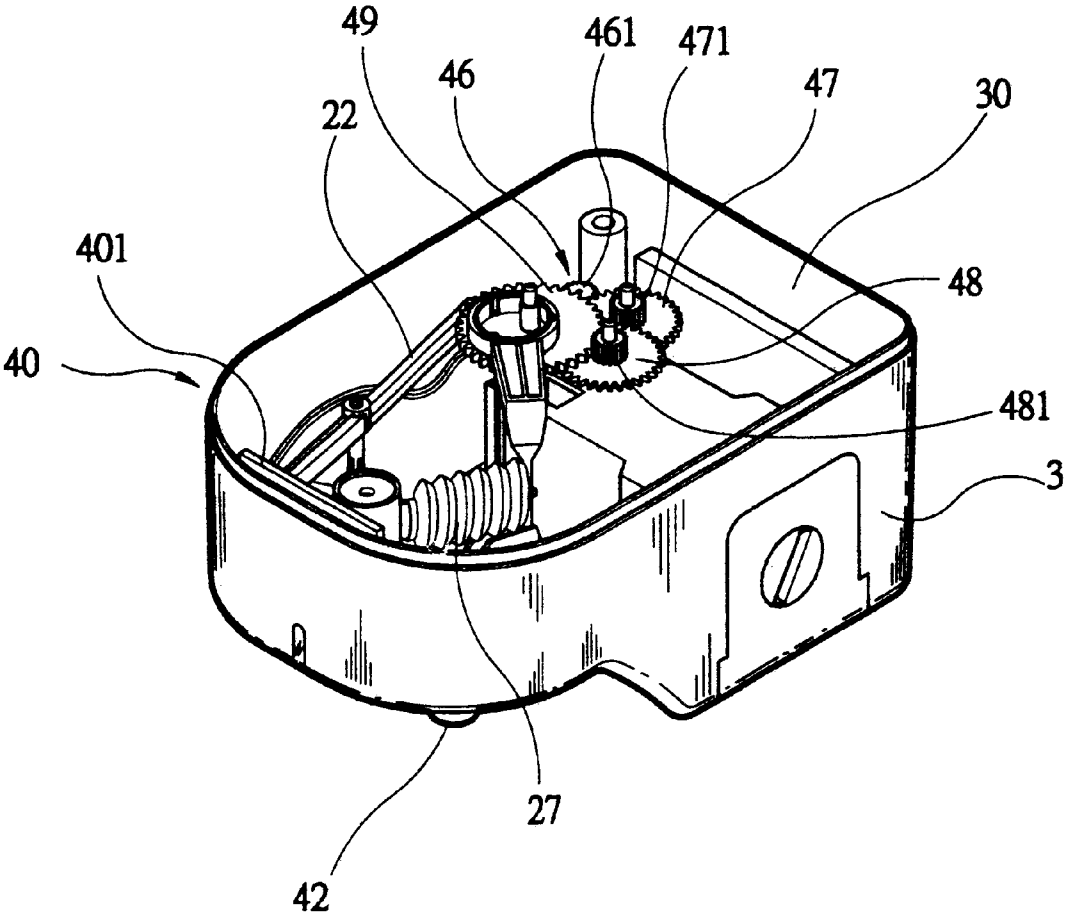
FIG. 3 is a perspective view of FIG. 1, where the upper housing removed to show the interior features of the soap feeding device.
Figure 4B:
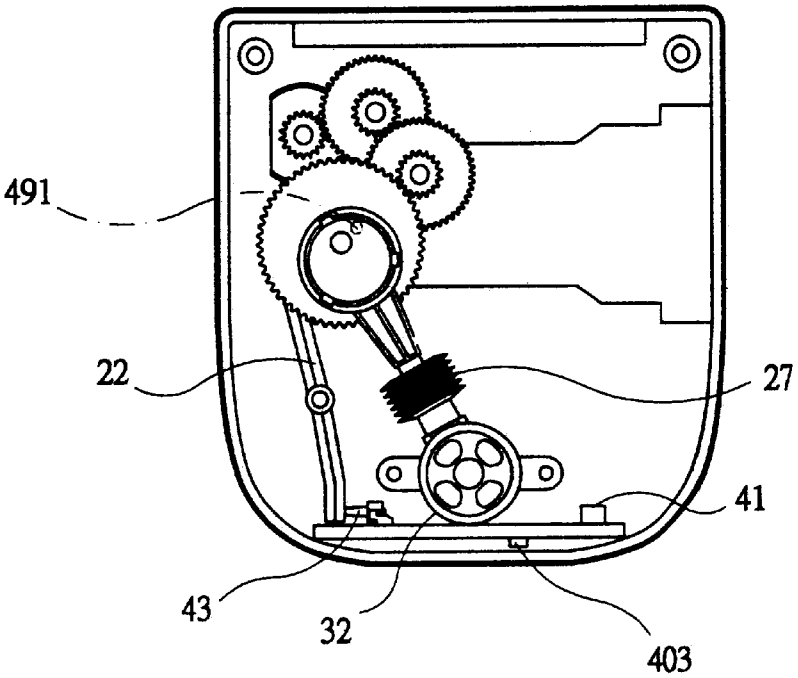
FIG. 4B is similar to FIG. 4A, where the feeding means has been activated.
Figure 4A:
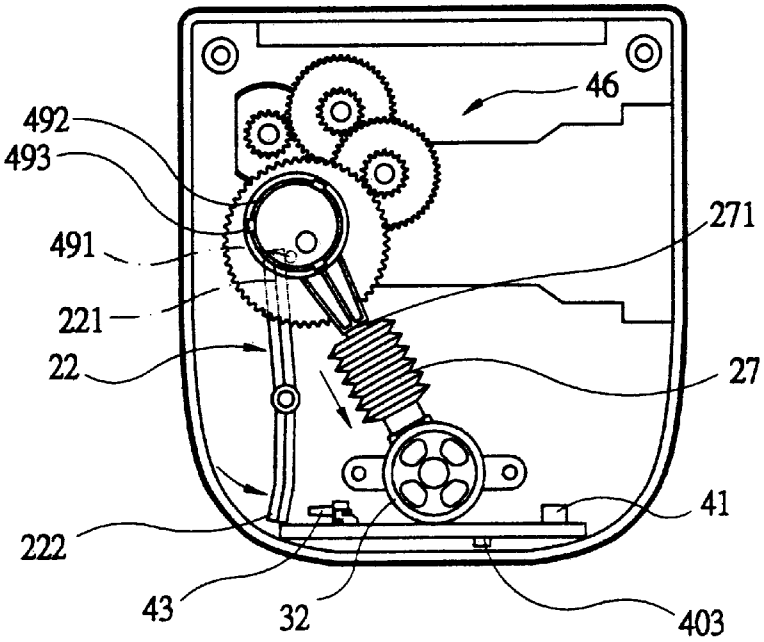
FIG. 4A is a top plan view of FIG. 3, where the feeding means has not been activated.
Figure 5:
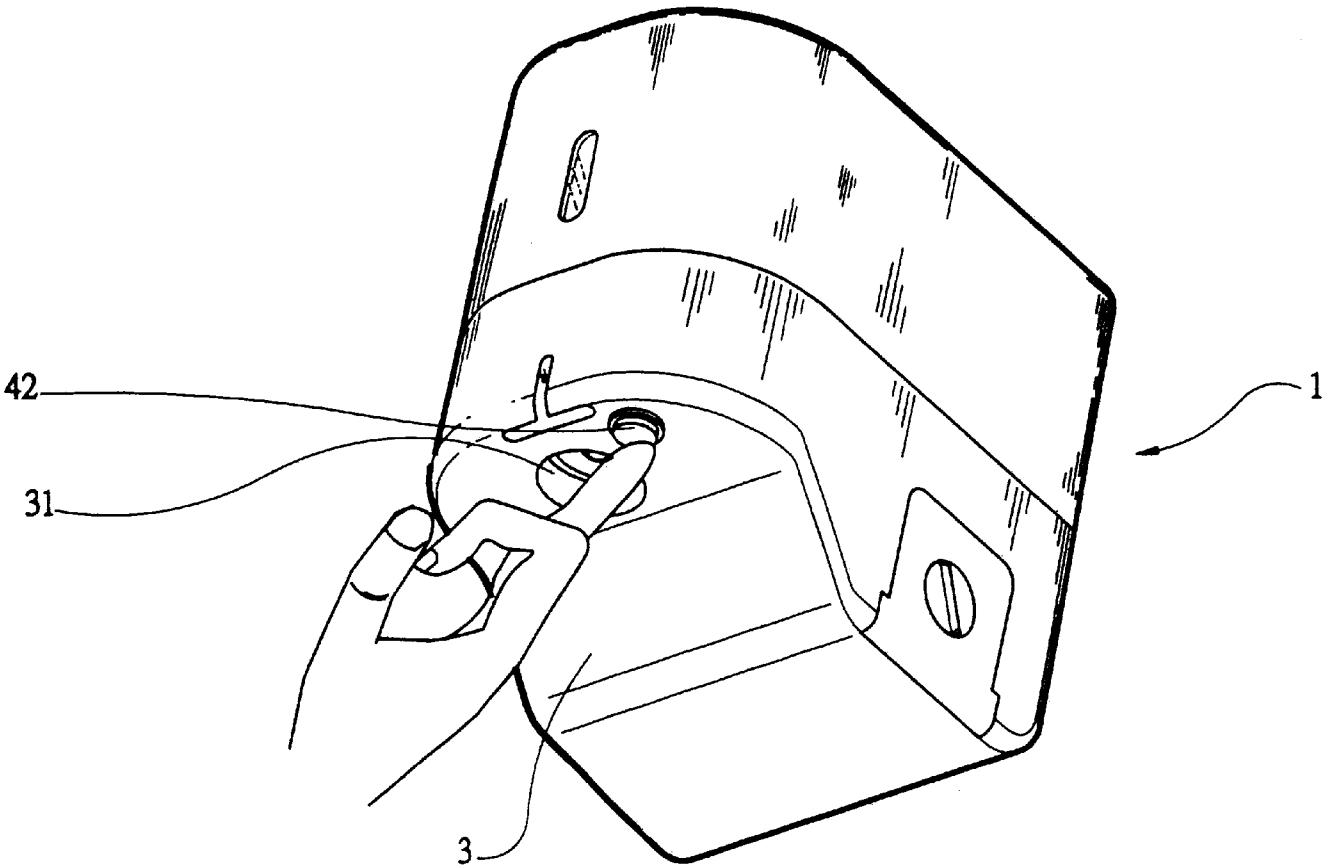
FIG. 5 is a perspective view to show the operation of the soap feeding device of FIG. 1.
Figure 6:
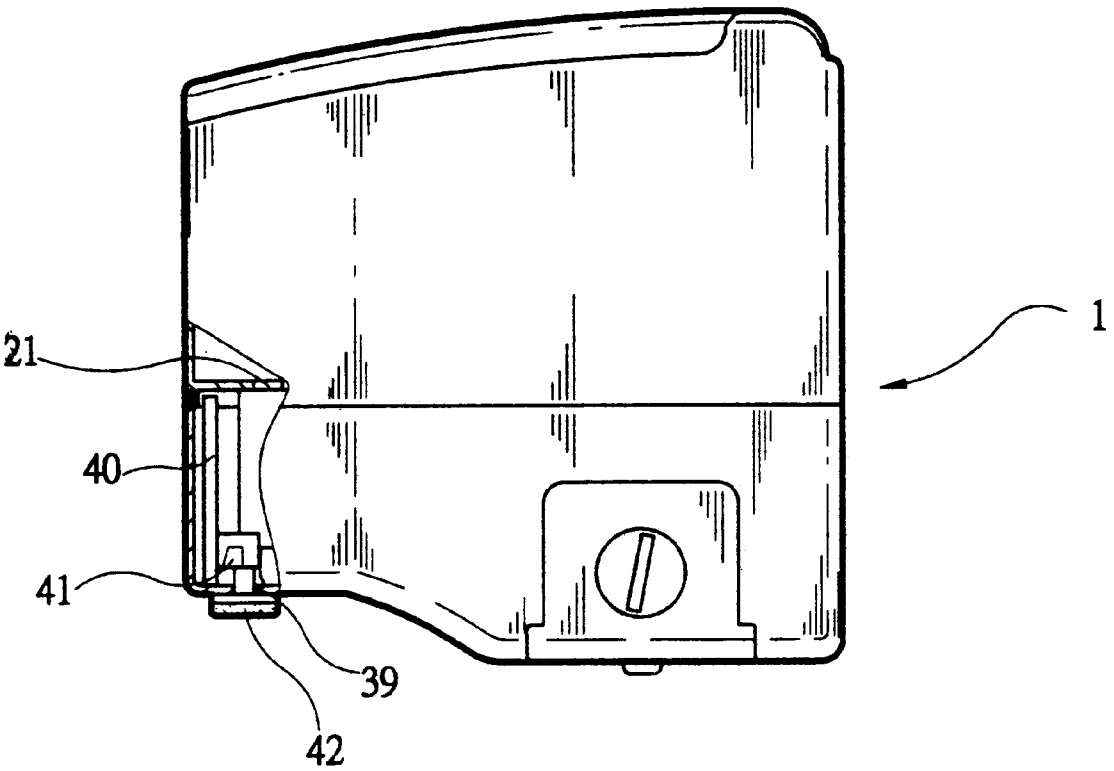
FIG. 6 is a side view in part section of FIG. 5.

Referring to FIGS. 1 to 6, there is shown a soap feeding device constructed in accordance with the invention. The soap feeding device is mounted in a housing 1 comprising an upper housing 2 having a reservoir 20 for storing soap and a cover 10 hinged to the soap reservoir 20, and a lower housing 3 having a control assembly 30 consisting of a power source 5, a sensor means 40, a transmission means 44 including a drive means 45, a reduction gear set 46, and a crankshaft 23, and a feeding means 27.

Sensor means 40 comprises a circuit board 401, a setting switch 41 on circuit board 401 extended through hole 39 (FIG. 6) in the bottom of lower housing 3, a waterproof silicone switch 42 enclosed the setting switch 41 such that user may press the silicone switch 42 to set the dropping of the soap feeding device, an infrared sensor 402, and an LED indicator 403. The factory preset dropping of soap is one in each activation of the soap feeding device. However, the invention allows user to set the dropping of soap more than one. In setting the dropping, user may press the silicone switch 42 once to cause LED indicator 403 to flash twice. This means that two drops will be extruded when the infrared sensor 402 senses the stretching out of one's hand. User may press the silicone switch 42 once more to cause LED indicator 403 to flash trice. This means that three drops will be extruded when the infrared sensor 402 senses the stretching out of one's hand. This procedure may continue until a desired number of dropping of soap or an allowable maximum number of settings is reached. User may press the silicone switch 42 again when the setting is complete. At this time, the setting of the dropping of soap is returned to one drop.

The power source 5 is activated once the infrared sensor 402 senses the stretching out of one's hand. Then motor 451 of the drive means 45 is activated to cause reduction gear set 46 to rotate. A pinion 461 is put on the output shaft of motor 451 for passing the motion on to middle gear 47. A second pinion 471 is put on the spindle of middle gear 47 for passing the motion on to second middle gear 48. Similarly, a third pinion 481 is put on the spindle of second middle gear 48 for passing the motion on to a large gear 49. An eccentric ring 492 having two hooks 493 is provided on large gear 49. Each hook 493 is hooked on the engagement end 231 of crankshaft 23. As such, the rotation of large gear 49 may cause the engagement end 231 to move the cylindrical end 232 of the L-shaped crankshaft 23. The movement of the cylindrical end 232 is defined by the pair of dips 26 raised on the bottom of lower housing 3. Thus the cylindrical end 232 of the L-shaped crankshaft 23 is limited to a reciprocating motion.

Also, the cylindrical end 232 of the L-shaped crankshaft 23 is inserted in the end 271 of bellow-like extruder 270 of feeding means 27. As such, the bellowlike extruder 270 may compress air into a barrel 32. The vibration of the cylindrical end 232 of the L-shaped crankshaft 23 during the extrusion of extruder 270 as experienced in the prior art is eliminated due to the insertion of cylindrical end 232 into the clips 26 in the lower housing 3. Thus a smooth extrusion of soap is effected.

Barrel 32 is in fluid communication with the outlet 21 in the bottom of soap reservoir 20 of upper housing 2. Barrel 32 comprises a slidable valve 35 therein. The valve 35 is a plate member having a plurality of through holes 352, an annular membrane 351 adhered to the wall of the barrel 32, a spindle 353 extended down from the valve 35, a spring 36 anchored on top of the valve 35, a cap 37 on top of spring 36, the periphery of cap 37 engaged with the top of barrel 32, a plurality of apertures 371 on the cap 37 for permitting soap to flow through into barrel 32, and a poppet member 34 having a center hole 342 put on the spindle 353 and a poppet 343. The seat 341 of poppet member 34 is biased against the bottom hole 33 of barrel 32 for blocking soap passage when the soap feeding device is not activated. When extruder 270 is activated, i.e., extruder 270 is compressed, valve 35 is moved up due to the upward movement of poppet 343 actuated by extruder 270, i.e., valve 35 is open. As a result, the bottom hole 33 of barrel 32 is open to permit soap to pass for extruding through the outlet 31 in the bottom of lower housing 3. In the immediate expansion of extruder 270, crankshaft 23 moves back to its original position which in turn causes a sucking effect in barrel 32. As a result, soap is supplied from soap reservoir 20 to the barrel 32 through apertures 371 and poppet 343.

A pivot member 22 is formed in the lower housing 3. A push-button switch 43 is formed on circuit board 401. A projection 491 is provided on an eccentric position of large gear 49. Projection 491 will engage with one end 221 of pivot member 22 when extruder 270 is compressed by the rotation of large gear 49. As such, the other end 222 of pivot member 22 presses the push-button switch 43 once in each extrusion of soap. Above extrusion may repeat until the times of dropping set by user in advance has been reached. Once reached, the drive means 45 is deactivated by the circuit board 401 (see FIGS. 4A and 4B).

The benefits of this invention includes:

1. User can set the dropping control mechanism based on demand in order to extrude a required amount of soap including a plurality of drops from the soap feeding device in one stretching out of one's hand.
2. The silicone switch is waterproof.
3. The extruder will not vibrate during the extrusion process. Thus a smooth extrusion of soap is effected.

While the invention herein disclosed has been described by means of specific embodiments, numerous modifications and variations could be made thereto by those skilled in the art without departing from the scope and spirit of the invention set forth in the claims.

What is claimed is:

1. A soap feeding device mounted in a housing comprising an upper housing having a soap reservoir and a lower housing having an outlet in the bottom and a control assembly consisting of a power source, a sensor means including a circuit board with a setting switch extended through the bottom of the lower housing, a transmission means including a drive means, a reduction gear set with a large gear, and a crankshaft, and a feeding means including a bellow-like extruder, wherein the soap dropping of the device is set by the pressing of the setting switch.

2. The soap feeding device of claim 1, further comprising a waterproof silicone switch for enclosing the setting switch.

3. The soap feeding device of claim 1, further comprising a barrel having a top opening in fluid communication with the soap reservoir, a side opening in fluid communication with the bellow-like extruder, and a bottom hole and a pair of clip raised on the bottom of the lower housing wherein the power source is activated when the sensor means senses, the reduction gear set is driven to rotate, the rotation of the large gear of the reduction gear set causes one end of the crankshaft to rotate and the other end of the crankshaft to move between the pair of clips, and the other end the crankshaft is further attached to one end of the bellow-like extruder such that extruder reciprocally compresses air into the barrel for extruding soap.

4. The soap feeding device of claim 3, further comprising a plate-shaped valve slidable in the barrel comprising a plurality of through holes, an annular membrane adhered to the wall of the barrel, a spindle extended down from the valve, a spring anchored on top of the valve, a cap on the top of the spring, the periphery of the cap engaged with the top of the barrel, a plurality of apertures on the cap for permitting soap to flow through into the barrel, and a poppet member having a center hole put on the spindle, a poppet, and a seat biased against the bottom hole of the barrel, wherein the seat is biased against the bottom hole of the barrel for blocking soap from passing through the bottom hole of the barrel when the soap feeding device is not activated, and when the extruder is compressed, the valve is moved up due to the upward movement of the poppet actuated by the extruder which in turn causes the bottom hole of the barrel to open to permit soap to pass for extruding through the outlet of the lower housing.

5. The soap feeding device of claim 4, further comprising a pivot member in the lower housing, a push-button switch on the circuit board, and a projection on the eccentric position of the large gear, wherein the projection engages with one end of the pivot member when the extruder is compressed by the rotation of the large gear such that the other end of the pivot member presses the push-button switch once in each extrusion of soap, the extrusion is repeated until the set times of the soap dropping of the device has been reached, and the drive means is deactivated by the circuit board accordingly.

* * * * *